US008931915B1

(12) United States Patent
Wang

(10) Patent No.: US 8,931,915 B1
(45) Date of Patent: Jan. 13, 2015

(54) ANTI-OPENING STRUCTURE FOR A LIGHTING DEVICE

(71) Applicant: Day Sun Technology Ltd., Tainan (TW)

(72) Inventor: Shih-Hao Wang, Tainan (TW)

(73) Assignee: Day Sun Technology Ltd., Tainan (TW)

( * ) Notice: Subject to any disclaimer, the term of this patent is extended or adjusted under 35 U.S.C. 154(b) by 0 days.

(21) Appl. No.: 14/029,861

(22) Filed: Sep. 18, 2013

(51) Int. Cl.

| | |
|---|---|
| ***F21V 15/01*** | (2006.01) |
| ***F21V 17/00*** | (2006.01) |
| ***F21V 25/00*** | (2006.01) |
| *F21L 4/00* | (2006.01) |

(52) U.S. Cl.
CPC . *F21V 25/00* (2013.01); *F21L 7/00* (2013.01); *F21L 4/00* (2013.01)
USPC ..... 362/186; 362/157; 362/376

(58) Field of Classification Search
CPC ..... F21L 4/00–4/085; F21L 7/00; F21V 25/00–25/125
USPC ..... 362/157–208, 376–378, 353, 344
See application file for complete search history.

(56) References Cited

U.S. PATENT DOCUMENTS

2012/0281394 A1* 11/2012 Weber ..... 362/186
2014/0192523 A1* 7/2014 Wang ..... 362/202

* cited by examiner

*Primary Examiner* — Mariceli Santiago
(74) *Attorney, Agent, or Firm* — Alan D. Kamrath; Kamrath IP Lawfirm, P.A.

(57) ABSTRACT

The present invention provides an anti-opening structure of a lighting device. A recess area preset at a lower portion under an external thread section formed at a lighting source main body is disposed with a restraining member. A hole preset at a lower end of an internal thread section, formed inside of a cap, combines with a nut to allow a screw to be screwed out through the nut outwards the cap. The screw is formed with a projecting circular portion. The cap screwing into the end of the lighting device main body is configured with the anti-opening structure. The screw is screwed into the restraining member by inserting an end of a tool into the screw protruding out of an outside of the cap. The screw is unable to screw in when the projecting circular portion abuts against the restraining member to provide the cap with the anti-opening structure.

3 Claims, 8 Drawing Sheets

ANTI-OPENING STRUCTURE FOR A LIGHTING DEVICE

BACKGROUND OF THE INVENTION

1. Field of the Invention

The present invention provides an anti-opening structure of a lighting device, which is mainly for preventing the cap of the lighting device with lighting function from being opened. A recess area preset at an end of a lighting device main body is disposed with a restraining member for a screw screwing through a side hole of the cap at the end of the lighting device main body to abut against. Therefore, the screw would not be overly screwed in, and the function of cap anti-opening is provided at the end of the lighting device.

2. Descriptions of the Related Art

According to UL, one of the safety requirements that the current lighting device products for lighting must meet is that the cap of the lighting device can not be removed by free hands unless being removed with the assistance of tools. Thus, the relevant industry starts to design the cap and the lighting device to pack and clip with each other during assembly or to be integrated altogether. The user needs tools to disassemble the device while replacing the bulb or the other end of the lighting device is formed with removable objects for bulb replacement.

As FIG. 1 shows, a present anti-opening structure of a lighting device is disclosed. The anti-opening structure comprises a lighting device main body 10 and a cap 20, wherein a front end of the lighting device main body 10 is formed with an external thread section 101, and a recess area 102 is formed at a lower portion of the external thread section 101. The inner portion of the cap 20 is formed with an internal thread section 201 for the external thread section 101 at the front end of the lighting device main body 10 to screw with. An internal thread hole 202 is formed on a side of a lower portion below the cover 20 for a screw 30 with a predetermined length to pass outwards through the internal thread hole 202. The internal thread section 201 at the end of the cap 20 directly screws in correspondingly to the outer screw section 101 of the lighting device main body 10 when the cap 20 screws on the lighting device main body 10 as shown in FIG. 3. As shown in FIGS. 2 and 4, a screw 30 passing through a side of the cap 20 protrudes outwards.

The anti-opening structure of the lighting device 40 screwed with the cap 20 as shown in FIG. 5 is to put a functional end of a tool 50 on an outer recess 301 of the screw 30 protruding out of an end of the cap 20. The tool 50 screws an inner end of the screw 30 into the recess area 102 of a corresponding portion of the lighting device main body 10. Thereby, the cap 20 covered at the end of the lighting device 40 can be removed with free hands. However, if the user screws with too much strength to make the screw 30 overly screwed, a gap 401 would be formed between the lighting device main body 10 and the cap 20 when the end of the screw 30 presses against the lighting device main body 10. The functions of the lighting device are affected.

SUMMARY OF THE INVENTION

The present invention fixes the problem that a gap would be formed when the screw for anti-opening a cap covered at an end of a lighting device main body is overly screwed and the lighting device is pressed. A restraining member is disposed in a recess area preset at an end of the lighting device main portion for the screw passing through a side hole of the cap screwing in at an end of the lighting device main body and screwing inwards to abut against in case of the screw overly screwed. Therefore, the cap at the end of the lighting device is configured with the anti-opening structure without affecting the existing function of the lighting device.

The primary objective of the present invention is preventing a cap screwed in at an end of the lighting device from being unscrewed with free hands. A recess area preset at a lower portion under an external thread section formed at an end, for disposing a lighting source, of a lighting source main body, is disposed with a restraining member. A through hole preset at a lower end of an internal thread section, formed adjacent to an inner side of a cap screwing in an end of the lighting device main body, combines with a nut to allow a screw with a predetermined length to screw out through the nut outwards the cap. A predetermined section of an end of the screw is formed with a projecting circular portion. The cap screwing into the end of the lighting device main body and forming the lighting device is configured with the anti-opening structure. The screw is screwed into the restraining member of a corresponding portion of the lighting device main body by inserting an end of a tool into the screw protruding out of an outside of the cap. The screw is unable to screw in when the projecting circular portion at the end of the screw abuts against an outer periphery of the restraining member to avoid a gap formed between the lighting device main body and the cap, and the cap at the end of the lighting device main body is configured with the anti-opening structure.

A second objective of the present invention is that the projecting circular portion at the predetermined section of the screw screwing into a side of the cap and combining with the nut is determined according to matching the outer periphery of the restraining member disposed in the lighting device main body. A length from another end to the projecting circular portion of the screw is slightly shorter or equal to depth of the restraining member.

The third objective of the present invention is that the restraining member at the lower portion under the external thread section disposed in the lighting device main body is slightly shorter than a permitted depth of the recess area. A thread section formed in an inner periphery of the restraining member is determined according to the screw screwing into a side of the cap.

DESCRIPTION OF THE PREFERRED EMBODIMENT

Figure 1:
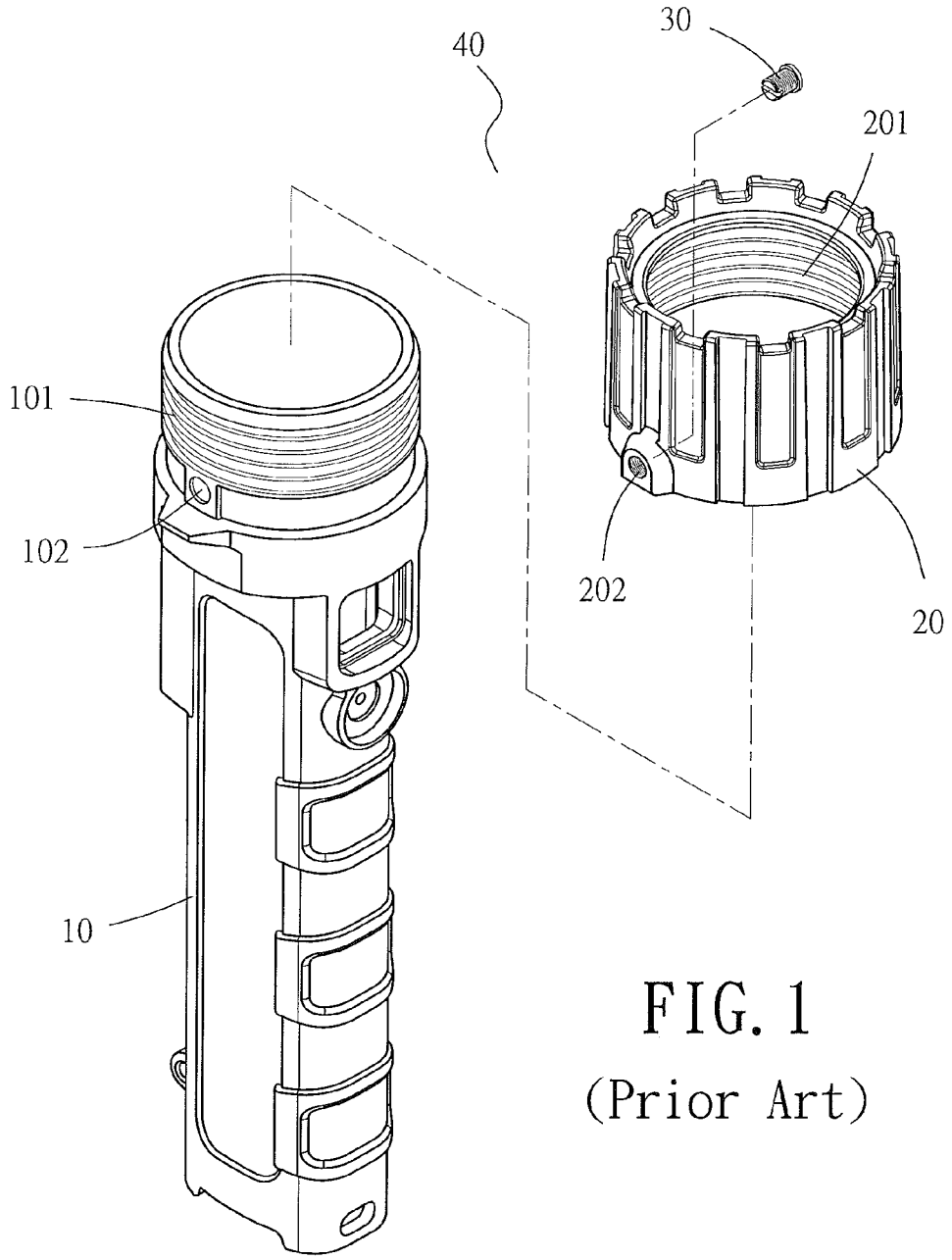
FIG. 1 (Prior Art)
FIG. 1 is a parts breakdown diagram of a conventional lighting device with an anti-opening structure.
Figure 2:
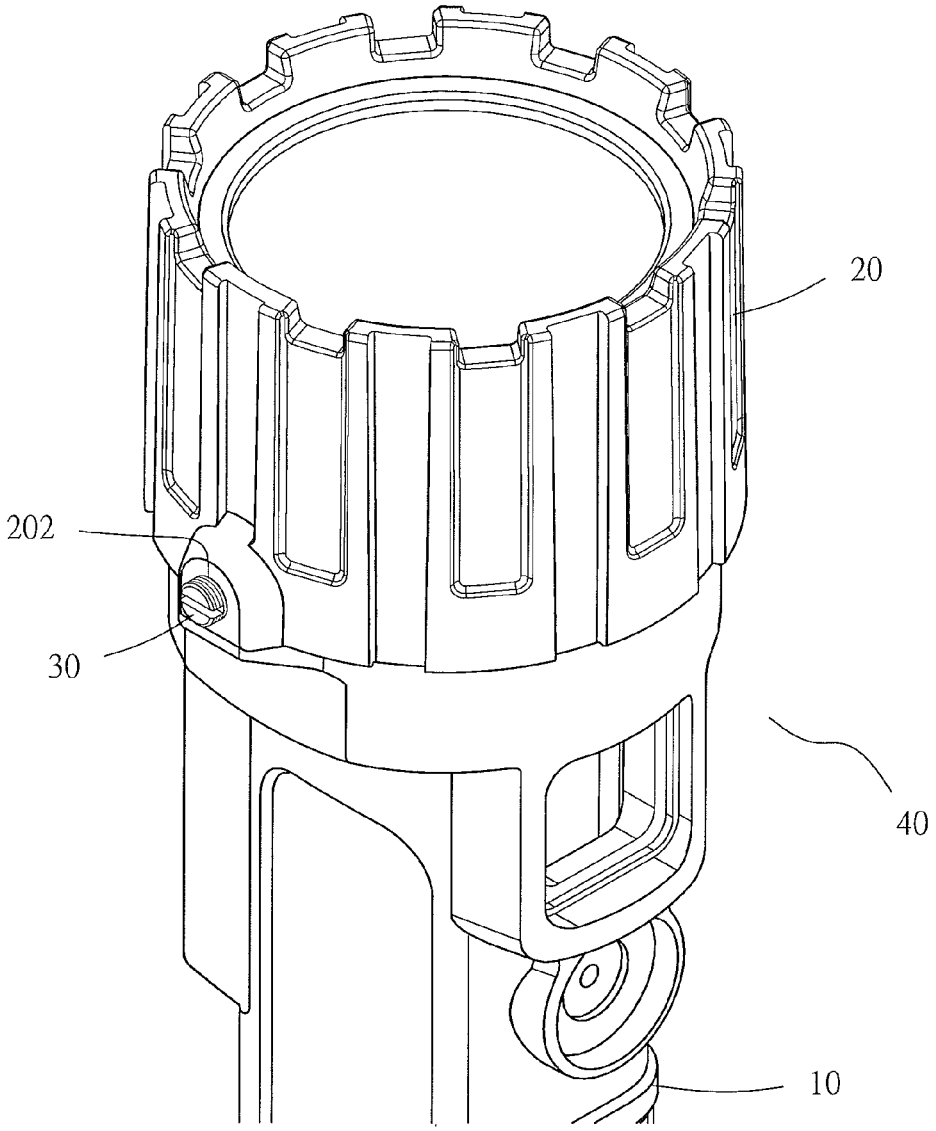
FIG. 2 (Prior Art)
FIG. 2 is an assembled external view of the conventional lighting device with the anti-opening structure.
Figure 3:
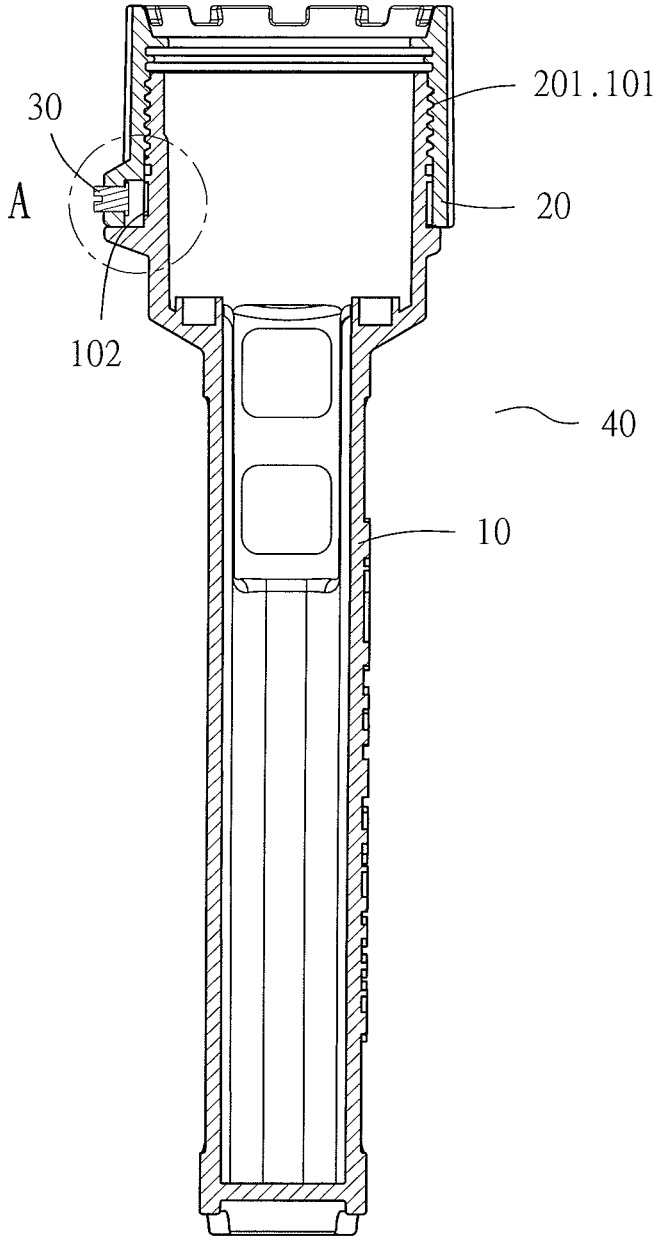
FIG. 3 (Prior Art)
FIG. 3 is a cross-sectional view of the assembled conventional lighting device with the anti-opening structure.
Figure 4:
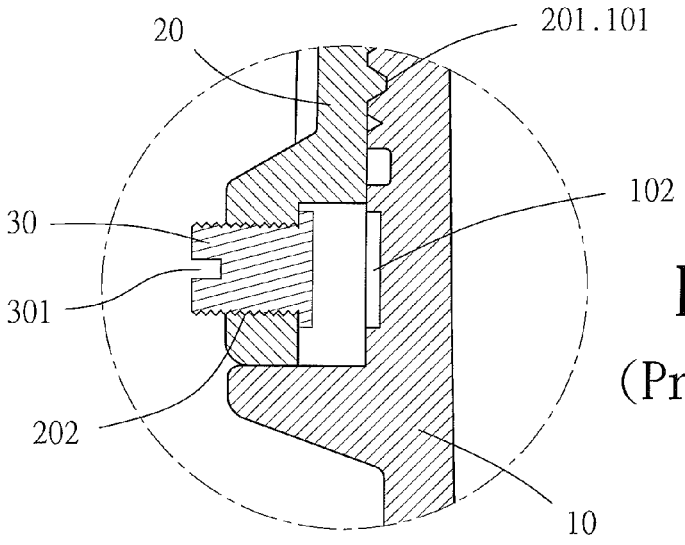
FIG. 4 (Prior Art)
FIG. 4 is an enlarged view of A portion of FIG. 3.
Figure 5:
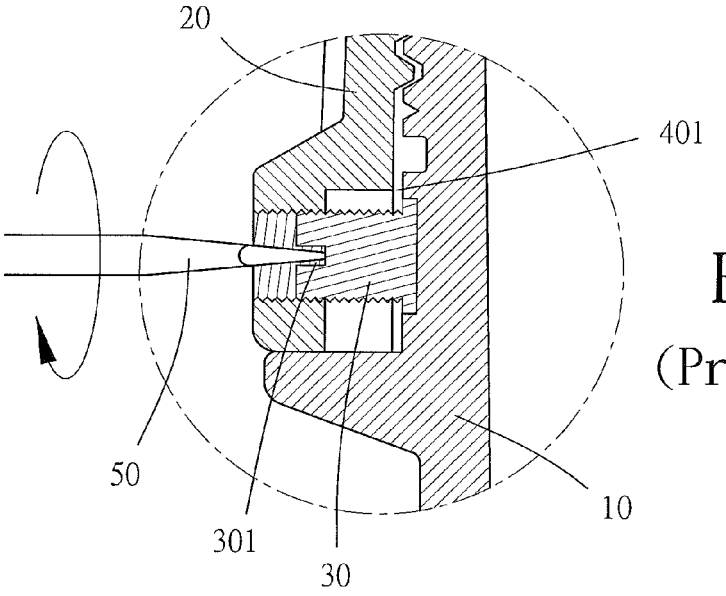
FIG. 5 (Prior Art)
FIG. 5 is a schematic view of screwing the screw with the tool of the conventional lighting device with the anti-opening structure.
Figure 6:
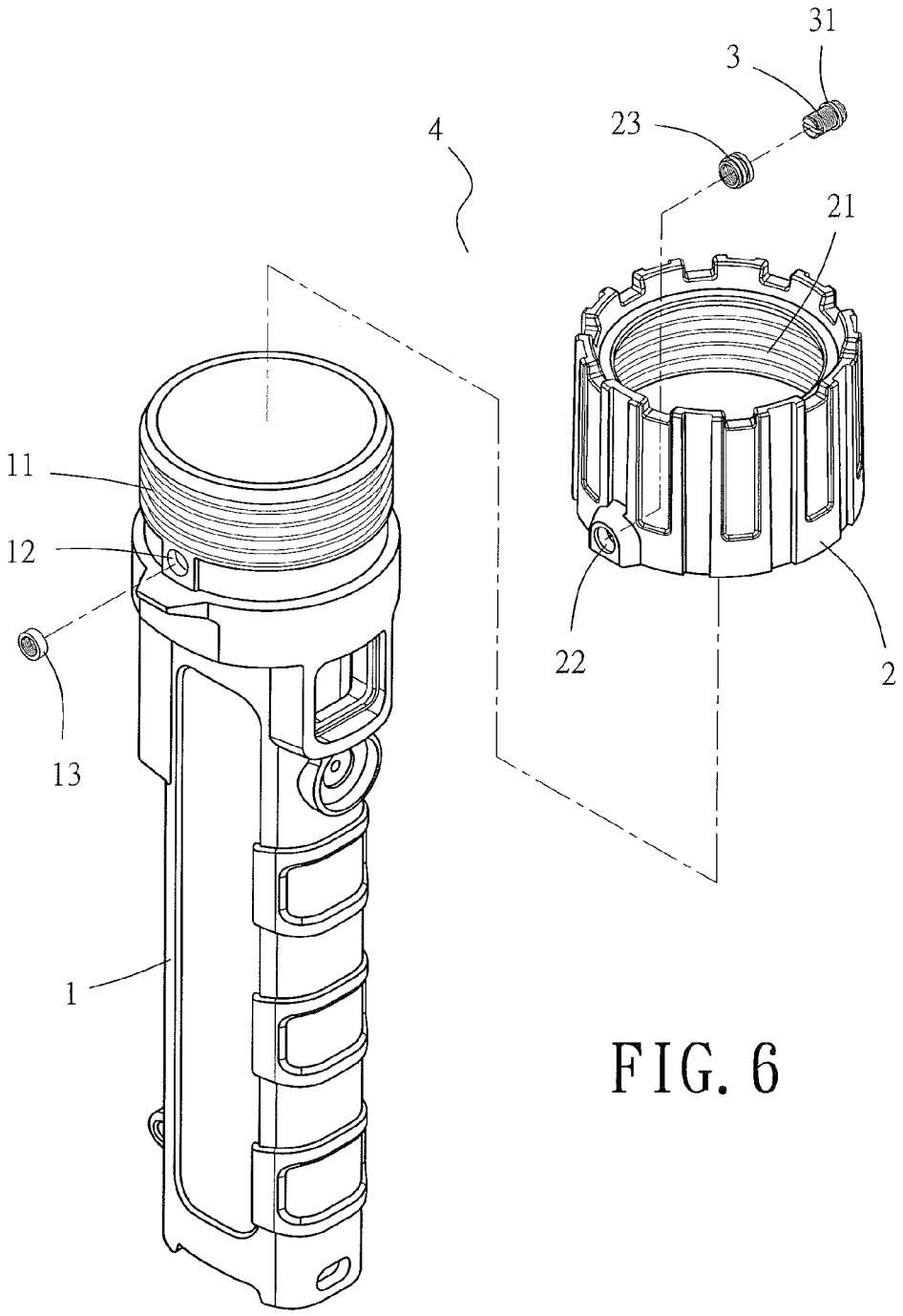
FIG. 6 is a parts breakdown diagram of a lighting device with an anti-opening structure in accordance with the present invention.

The present invention designs an anti-opening structure of a lighting device. Because of the anti-opening structure of the lighting device of the present invention can be widely used, such as with the battery box covers, flashlight lamp caps, etc., a flashlight lamp cap (as shown in FIG. 6) is used as an example of the implementation in this specification. The configuration that can't be screwed open with free hands is formed at a cap 2 screwed in at one end of the lighting device and comprises a lighting device main body 1 and the cap.

Figure 9:
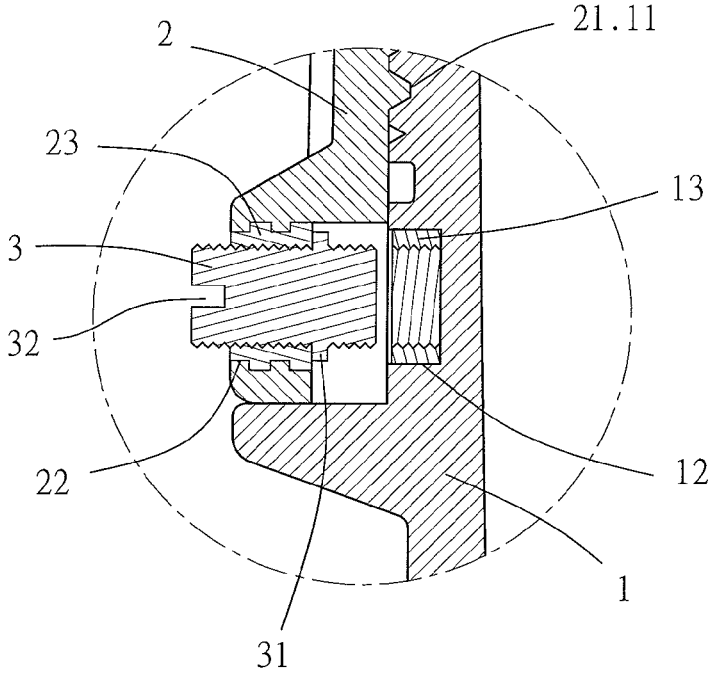
FIG. 9 is an enlarged view of A portion of FIG. 8.

The lighting device main body 1 is formed with an external thread section 11 at the end which assembled with a lighting source, and is preset a recess area 12 at a lower portion under the external thread section 11 to be disposed with a restraining member 13 as shown in FIGS. 6 and 9. The restricting member 13 is slightly shorter than a depth of the recess area 12, and a thread section formed in an inner periphery of the restraining member 13.

The cap 2 has a preset shape of a hollow cap determined from the external thread section 11 at one end of the lighting device main body 1. An internal thread section 21 is on an inner side of the cap 2, and a through hole 22 is formed at a lower end of the internal thread section 21 for a combination with a nut 23 as shown in FIGS. 6 and 9. The nut 23 disposed in the cap 2 is threaded through by a screw 3 with a predetermined length. The screw 3 extends outwards the cap 2, and a predetermined section of the screw 3 is formed with a projecting circular portion 31. The projecting circular portion 31 is determined by an outer periphery of the restraining member 13 disposed in the lighting device main body 1. A length from another end to the projecting circular portion 31 of the screw 3 is slightly shorter or equal to depth of the restraining member 13.

Figure 7:
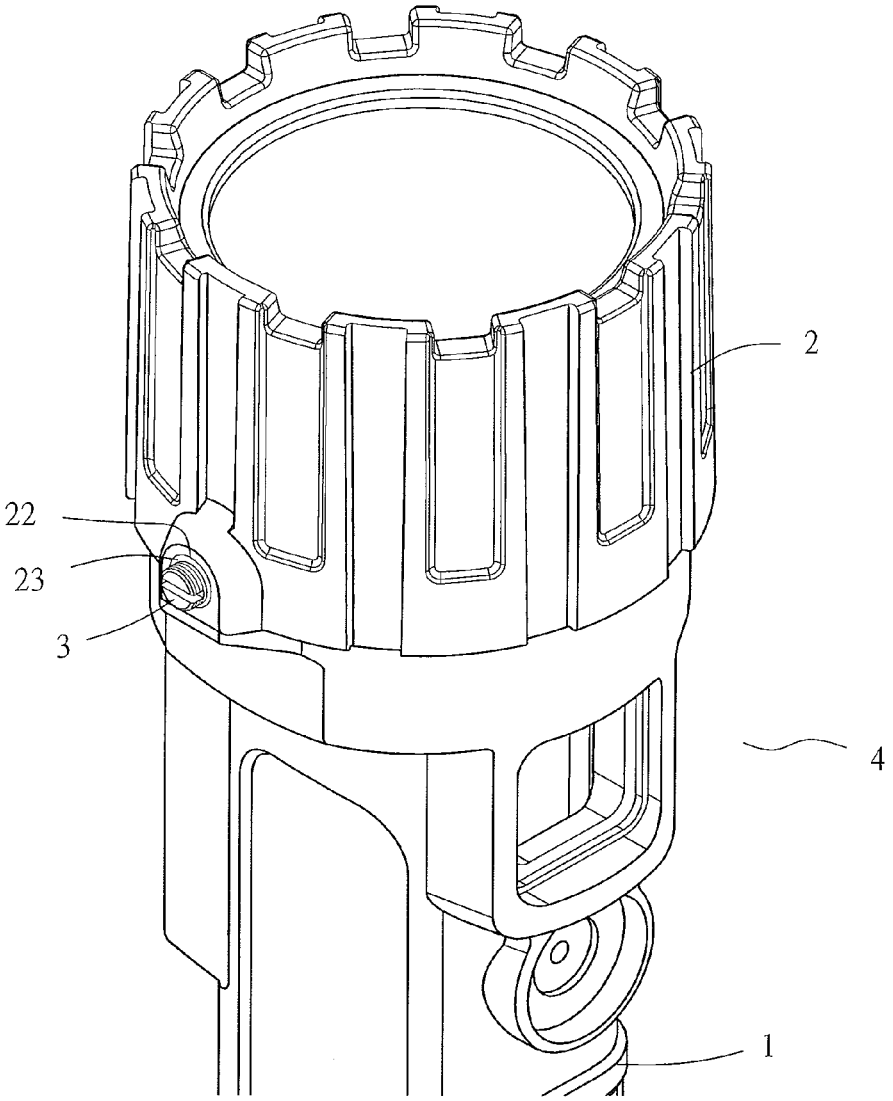
FIG. 7 is an assembled external view of the lighting device with the anti-opening structure in accordance with the present invention.
Figure 8:
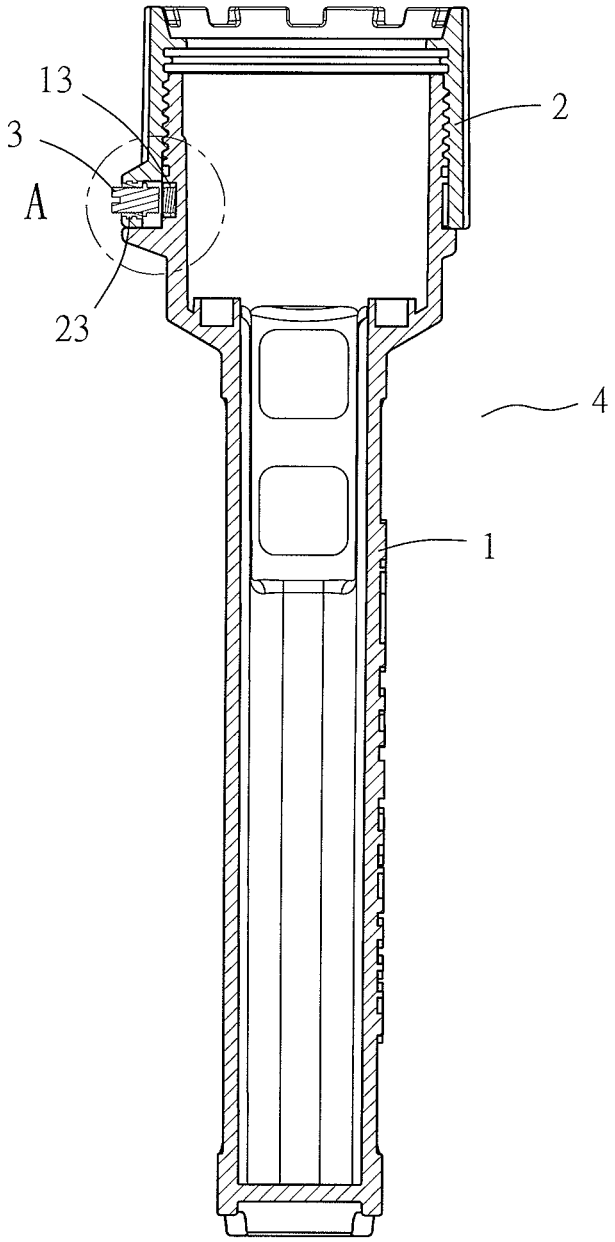
FIG. 8 is a cross-sectional view of the lighting device with the anti-opening structure in accordance with the present invention.

When assembling the recited lighting device main body 1 and the cap 2 as shown in FIG. 8, the internal thread section 21 of the inner side of the cap 2 is correspondingly screwed into the external thread section 11 at an end of the lighting device main body 1. The screw 3 passes through the nut 23 combined at one side of the cap 2 and protrudes out of an outside of the cap 2 as shown in FIG. 9. The lighting device 4 is thereby assembled as shown in FIG. 7.

Figure 10:
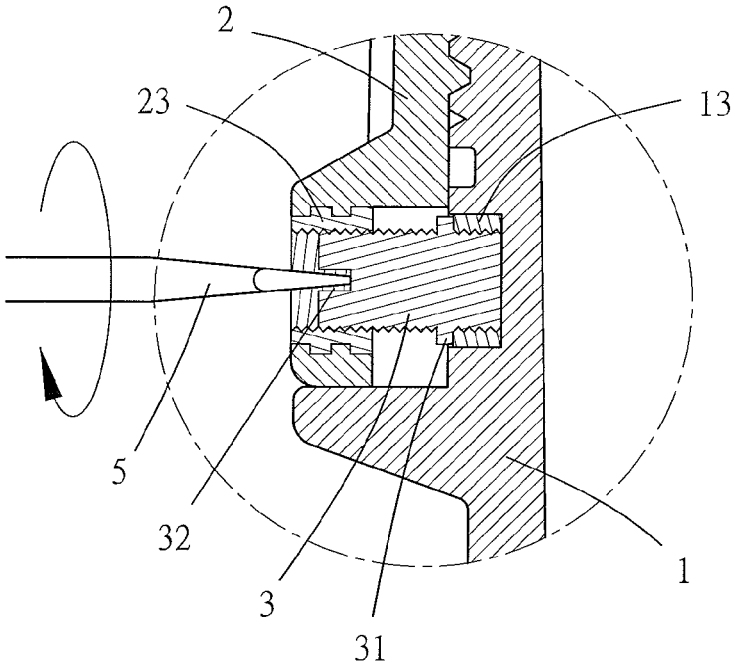
FIG. 10 is a schematic view of screwing the screw with the tool of the lighting device with the anti-opening structure in accordance with the present invention.

The assembled lighting device 4 is located at one end of the lighting device main body 1. The cap 2 screwed in at one end of the lighting device main body 1 is configured with cap anti-opening as shown in FIG. 10. An end of a tool 5 (a screw driver is used as an example) inserts into an external recess 32 of the screw 3 protruding out of the outside of the cap 2 to screw the screw 3 into the restraining member 13 at the corresponding portion of the lighting device main body 1. The screw 3 is unable to screw in when the projecting circular portion 31 at the end of the screw 3 abuts against an outer periphery of the restraining member 13 to avoid a gap formed between the lighting device main body 1 and the cap 2, and an original function of the cap 2 at the end of the lighting device main body 1 isn't affected by the anti-opening structure.

What is claimed is:

1. An anti-opening structure of a lighting device for preventing a cap screwed in at an end of the lighting device from being unscrewed with free hands, wherein a recess area preset at a lower portion under an external thread section formed at an end, for disposing a lighting source, of a lighting source main body, is disposed with a restraining member, a through hole preset at a lower end of an internal thread section, formed adjacent to an inner side of a cap screwing in an end of the lighting device main body, combines with a nut to allow a screw with a predetermined length to screw out through the nut outwards the cap, and a predetermined section of an end of the screw is formed with a projecting circular portion;

the cap screwing into the end of the lighting device main body and forming the lighting device is configured with the anti-opening structure, the screw is screwed into the restraining member of a corresponding portion of the lighting device main body by inserting an end of a tool into the screw protruding out of an outside of the cap, the screw is unable to screw in when the projecting circular portion at the end of the screw abuts against an outer periphery of the restraining member to avoid a gap formed between the lighting device main body and the cap, and an original function of the cap at the end of the lighting device main body isn't affected by anti-opening.

2. The anti-opening structure of the lighting device as claimed in claim 1, wherein the projecting circular portion at the predetermined section of the screw screwing into a side of the cap and combines with the nut is determined according to matching the outer periphery of the restraining member disposed in the lighting device main body, and a length from another end to the projecting circular portion of the screw is slightly shorter or equal to depth of the restraining member.

3. The anti-opening structure of the lighting device as claimed in claim 1, wherein the restraining member at the lower portion under the external thread section disposed in the lighting device main body is slightly shorter than a permitted depth of the recess area, and a thread section formed in an inner periphery of the restraining member is determined according to the screw screwing into a side of the cap.

* * * * *